US006742998B2

(12) United States Patent
Kawahara et al.

(10) Patent No.: US 6,742,998 B2
(45) Date of Patent: Jun. 1, 2004

(54) LINEAR COMPRESSOR WITH VIBRATION CANCELING SPRING ARRANGEMENT

(75) Inventors: Sadao Kawahara, Shiga (JP); Nobuaki Ogawa, Shiga (JP); Teruyuki Akazawa, Shiga (JP); Yasuhiro Asaida, Kyoto (JP); Masaru Nagaike, Osaka (JP); Hiroshi Hasegawa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 19 days.

(21) Appl. No.: 10/198,127

(22) Filed: Jul. 19, 2002

(65) Prior Publication Data

US 2003/0017064 A1 Jan. 23, 2003

(30) Foreign Application Priority Data

Jul. 19, 2001 (JP) ..... 2001-220541

(51) Int. Cl.[7] ..... F04B 17/04; F04B 17/00; F04B 35/00

(52) U.S. Cl. ..... 417/416; 417/415; 417/363; 417/902

(58) Field of Search ..... 417/363, 415, 417/416, 211, 902

(56) References Cited

U.S. PATENT DOCUMENTS 1,789,694 A * 1/1931 Beman ..... 417/416
3,325,085 A * 6/1967 Gaus ..... 230/55
4,360,087 A * 11/1982 Curwen ..... 188/379
4,854,833 A * 8/1989 Kikuchi et al. ..... 417/417
5,772,410 A * 6/1998 Chang ..... 417/363
6,129,527 A * 10/2000 Donahoe et al. ..... 417/416

FOREIGN PATENT DOCUMENTS

JP 11-117861 * 4/1999 ..... F04B/35/04
WO WO 00/32934 * 6/2000 ..... F04B/35/04

* cited by examiner

*Primary Examiner*—Justine R. Yu
*Assistant Examiner*—Timothy P. Solak
(74) *Attorney, Agent, or Firm*—Armstrong, Kratz, Quintos, Hanson & Brooks, LLP

(57) ABSTRACT

A linear compressor is provided in which a driving spring and an elastic supporting member for supporting a compressing mechanism portion are disposed such that a piston and the compressing mechanism portion move in opposite phases such that vibration of a hermetic vessel is canceled out. The linear compressor comprises a hermetic vessel having a compressing mechanism portion and a linear motor therein. The compressing mechanism portion includes a piston-side mechanism and a cylinder-side mechanism, the former includes the piston and the mechanism member which is movable together with the piston, the latter includes the cylinder and the stator which connects with the cylinder. The cylinder-side mechanism member is elastically supported at opposite ends in the hermetic vessel by a first elastic member, and a reciprocating force in the axial direction is given the piston-side mechanism by a second elastic member whose one end is supported by the hermetic vessel.

9 Claims, 5 Drawing Sheets

LINEAR COMPRESSOR WITH VIBRATION CANCELING SPRING ARRANGEMENT

BACKGROUND OF THE INVENTION (1) Field of the Invention

The present invention relates to a linear compressor for reciprocating a piston in a cylinder by a linear motor to suck, compress and discharge gas.

(2) Description of the Prior Art

In refrigeration cycles, HCFC refrigerants, such as R22, are stable compounds and decompose the ozone layer. In recent years, HFC refrigerants have begun to be utilized as alternative refrigerants of HCFCs, but these HFC refrigerants have the nature for facilitating global warming. Therefore, a study is started to employ natural refrigerants such as HC refrigerants which do not decompose the ozone layer or largely affect global warming. For example, since an HC refrigerant is flammable, it is necessary to prevent explosion or ignition so as to ensure safety. For this purpose, it is required to reduce the amount of refrigerant to be used to as small as possible. The HC refrigerant itself does not have lubricity and is easily melted into a lubricant. For these reasons, when an HC refrigerant is used, an oilless or oil-poor compressor is required. On the other hand, a linear compressors, in which a load applied in a direction perpendicular to an axis of its piston is small and a sliding surface pressure is small is known as a compressor which can easily realize oilless conditions as compared with a reciprocal type compressor, a rotary compressor or a scroll compressor.

However, in this linear compressor, propagation of vibration caused by reciprocating motion of the piston is a big problem. A system for elastically supporting a compressing mechanism portion in a hermetic vessel to suppress vibration is conventionally employed in many cases, but it is difficult to sufficiently suppress the vibration. Means for lowering the vibration by opposing two pistons to each other is used, but a very complicated design is required.

SUMMARY OF THE INVENTION

The present invention has been accomplished in view of the above circumstances, and it is an object of the invention to provide a linear compressor in which a driving spring and an elastic supporting member for supporting a compressing mechanism portion are disposed such that a piston and the compressing mechanism portion move in opposed phases so that vibration of a hermetic vessel is canceled out.

To achieve the above object, according to a first aspect of the present invention, there is provided a linear compressor comprising a hermetic vessel having a compressing mechanism portion and a linear motor therein, wherein the compressing mechanism portion comprises a cylinder and a piston which reciprocates in the cylinder, the linear motor comprises a moving member which provides the piston with reciprocating driving force and a stator which is fixed to the cylinder and which forms a reciprocation path for the moving member, the compressing mechanism portion and the linear motor are classified into a piston-side mechanism member and a cylinder-side mechanism member, the piston-side mechanism member includes the piston, the moving member and another mechanism member which is movable together with the piston and the moving member, the cylinder-side mechanism member includes the cylinder, the stator and another mechanism member fixed to the cylinder or the stator, the cylinder-side mechanism member is elastically supported in the hermetic vessel by a first elastic member, and a reciprocating force in the axial direction is given to the piston-side mechanism member by a second elastic member whose one end is supported by the hermetic vessel.

According to a second aspect of the invention, in the linear compressor of the first aspect, the first elastic member and the second elastic member respectively comprise spring members, and the first elastic member and the second elastic member are disposed such that their vibrating directions are the same.

According to a third aspect of the invention, in the linear compressor of the second aspect, a relation of substantially $Mp \times k1 = Mm \times k2$ is established, in which mass of the piston-side mechanism member is defined as Mp, mass of the cylinder-side mechanism member is defined as Mm, the spring constant of the first elastic member is defined as k1, and the spring constant of the second elastic member is defined as k2.

According to a fourth aspect of the invention, in the linear compressor of the second aspect, the first elastic member comprises a plurality of plate-like leaf springs.

According to a fifth aspect of the invention, in the linear compressor of the fourth aspect, the first elastic member comprises a combination of a pair of substantially C-shaped leaf springs, the second elastic member is a coil spring, and the second elastic member is disposed in a central space of the first elastic member.

According to a sixth aspect of the invention, in the linear compressor of the second aspect, the first elastic member is a non-linear spring having a linear spring stiffness up to a certain displacement and the spring stiffness is abruptly increased thereafter.

According to a seventh aspect of the invention, in the linear compressor of the sixth aspect, the first elastic member is a coil spring.

According to an eighth second aspect of the invention, in the linear compressor of the sixth aspect, the first elastic member is a laminated leaf spring.

According to a ninth aspect of the invention, in the linear compressor of any one of the first to eighth aspect, the linear compressor is operated using refrigerant mainly comprising carbon dioxide.

According to the first aspect, the cylinder-side mechanism member is elastically supported in the hermetic vessel by the first elastic member, and a reciprocating force in the axial direction is given to the piston-side mechanism member by a second elastic member whose one end is supported by the hermetic vessel. With this structure, since the amplitude of the piston-side mechanism member and the amplitude of the cylinder-side mechanism member are different in phase, vibration of the hermetic vessel becomes small.

According to the second aspect, in the linear compressor of the first aspect, the first elastic member and the second elastic member respectively comprise spring members, and the first elastic member and the second elastic member are disposed such that their vibrating directions are the parallel. With this structure, the amplitude of the piston-side mechanism member and the amplitude of the cylinder-side mechanism member becomes opposite in phase, and vibration transmitted to the hermetic vessel is canceled out. Therefore, a linear compressor having smaller vibration as compared with the first aspect can be obtained.

According to the third aspect, in the linear compressor of the second aspect, a relation of substantially $Mp \times k1 = Mm \times$ k2 is established, in which mass of the piston-side mechanism member is defined as Mp, mass of the cylinder-side mechanism member is defined as Mm, spring constant of the first elastic member is defined as k1, and spring constant of the second elastic member is defined as k2. With this structure, the vibration displacement of the hermetic vessel becomes substantially 0, and a linear compressor having almost no vibration can be obtained.

According to the fourth aspect, in the linear compressor of the second aspect, the first elastic member comprises a plurality of plate-like leaf springs. Since the leaf spring is strong against lateral load as compared with a coil spring, high reliability can be obtained even if disturbance force is applied to the compressor.

According to the fifth aspect, in the linear compressor of the fourth aspect, the first elastic member comprises a combination of a pair of substantially C-shaped leaf springs, the second elastic member is a coil spring, and the second elastic member is disposed in a central space of the first elastic member. With this structure, the compressor can be reduced in size in its longitudinal direction.

According to the sixth aspect, in the linear compressor of the second aspect, the first elastic member is a non-linear spring having a linear spring stiffness up to a certain displacement and the spring stiffness is abruptly increased thereafter. With this structure, even if extremely great disturbance force which coincides with resonance frequency of the mechanism member in the hermetic vessel is applied, if the first elastic member reaches a certain displacement, the resonance frequency of the mechanism member is deviated toward a higher value. Therefore, resonance disruption of the mechanism member is avoided.

According to the seventh aspect, in the linear compressor of the sixth aspect, the first elastic member is a coil spring. Since the non-linear spring comprises a coil spring which is easily produced, the spring can be produced with relatively low cost.

According to the eighth aspect, in the linear compressor of the sixth aspect, the first elastic member is a laminated leaf spring. Since the non-linear spring comprises the laminated leaf spring which is compact in its axial direction, the compressor can be reduced in size in its longitudinal direction.

According to the ninth aspect, in the linear compressor of any one of the first to eight aspects, refrigerant mainly comprising carbon dioxide is used. In addition to the effects of the first to eighth aspects, the linear compressor has smaller load in a direction perpendicular to an axis of its piston and has small sliding surface pressure. Thus, if $CO_2$ refrigerant in which it is difficult to lubricate with high different pressure refrigerant is used, efficiency is extremely excellent as compared with another compressor, and high reliability can be obtained.

DESCRIPTION OF THE PREFERRED EMBODIMENTS

Embodiments of a linear compressor of the present invention will be explained below based on the drawings.

Figure 1:
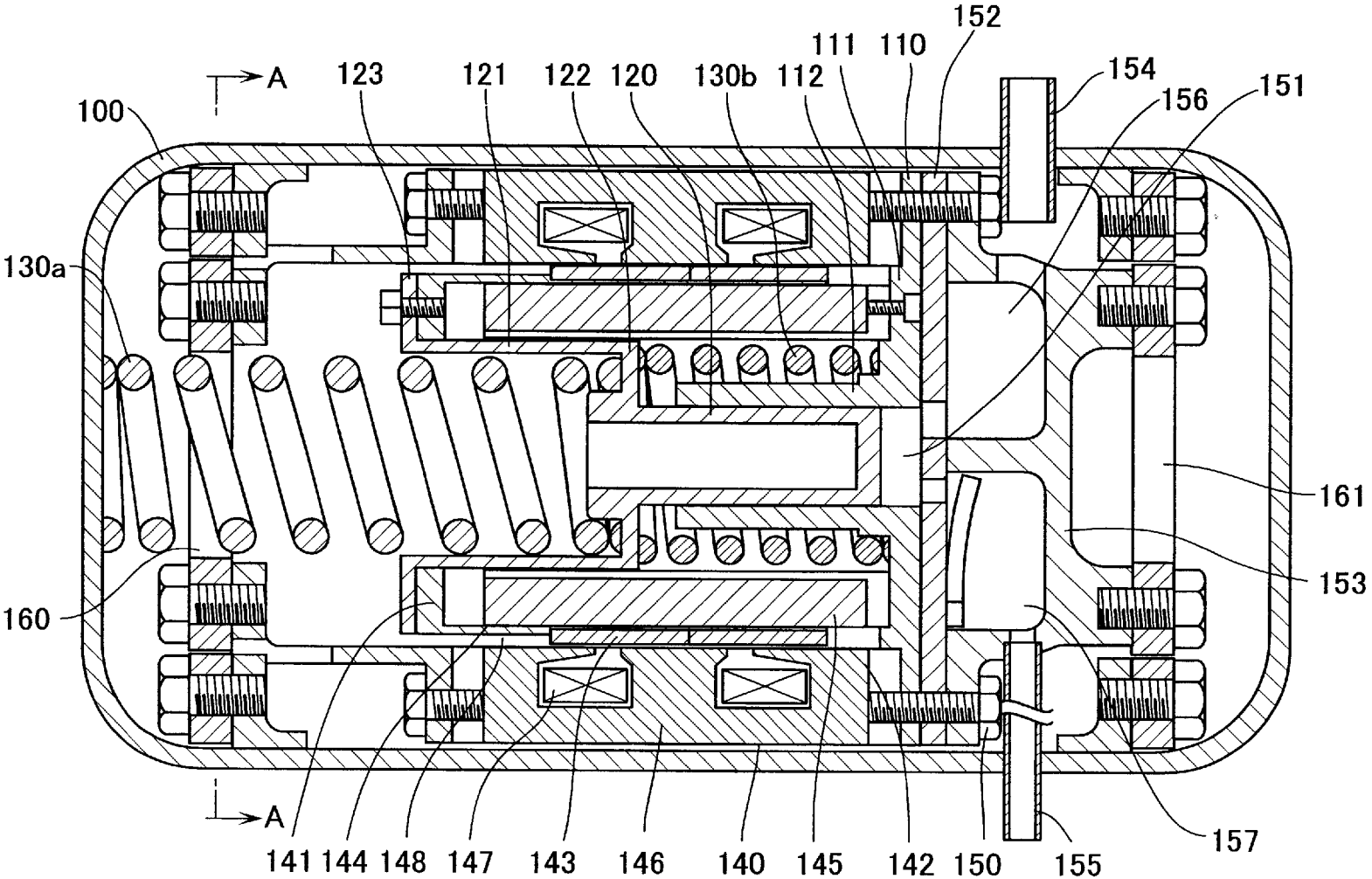
FIG. 1 is a side sectional view showing an entire structure of a linear compressor according to one embodiment of the present invention.
Figure 2:
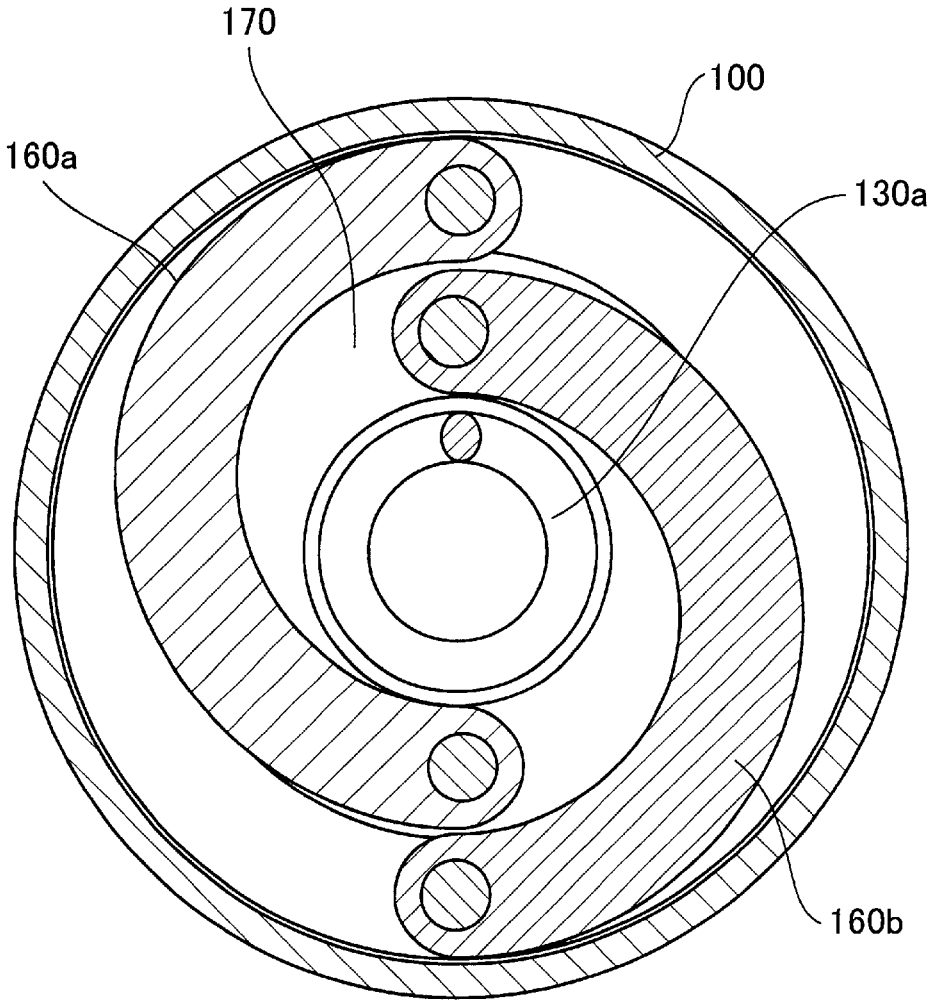
FIG. 2 is a sectional view taken along a line A—A in FIG. 1.
Figure 3:
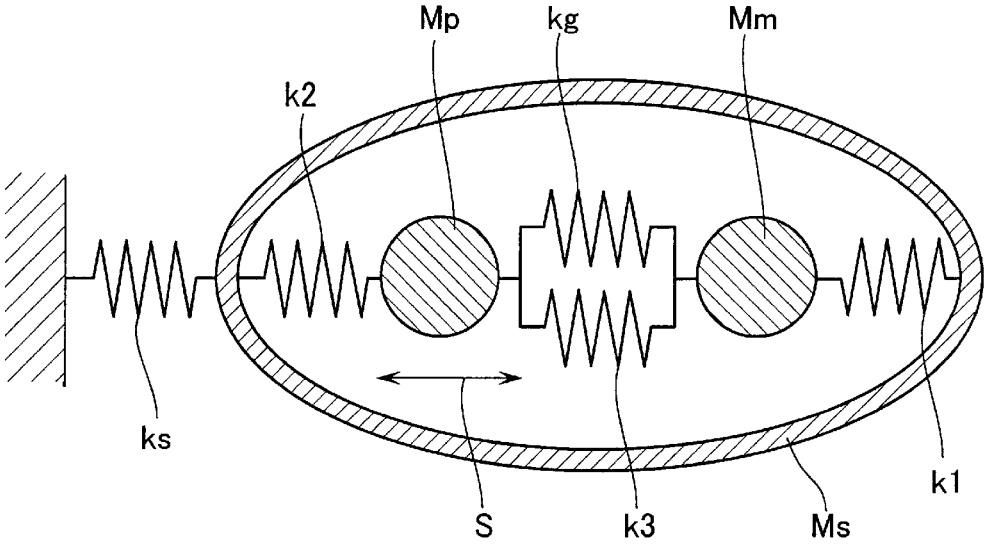
FIG. 3 is a diagram showing a spring/mass model of the linear compressor shown in the one embodiment of the invention.

FIG. 1 is a side sectional view showing an entire structure of a linear compressor according to one embodiment of the invention, FIG. 2 is a sectional view taken along a line A—A in FIG. 1, and FIG. 3 is a diagram showing a spring/mass model of the linear compressor shown in the one embodiment of the invention.

The entire structure of the linear compressor of the embodiment will be explained based on FIG. 1. The linear compressor comprises, in a hermetic vessel 100, a compressing mechanism portion and a linear motor 140.

The compressing mechanism portion includes a cylinder 110 and a piston 120 supported by the cylinder 110 such that the piston 120 can reciprocate along an axial direction of the cylinder 110. The cylinder 110 is integrally formed with a flat flange 111 and a cylindrical portion 112 projecting from a center of the flange 111 toward one end thereof. The cylindrical portion 112 is formed at its inner peripheral surface with a sliding surface against which the piston 120 abuts.

The piston 120 is supported by the sliding surface of the cylinder 110 such that the piston 120 can reciprocate. A cylindrical portion 121 is formed at an end of the piston 120 opposite from a compression chamber 151, and a flange 123 is formed on an end surface of the cylindrical portion 121.

The linear motor 140 comprises a moving member 141 and a stator 142.

The stator 142 of the linear motor 140 comprises an inner yoke 145 and an outer yoke 146. The inner yoke 145 comprises a cylindrical body, and is disposed on an outer periphery of the cylindrical portion 112 of the cylinder 110 and fixed to a cylinder flange 111. On the other hand, the outer yoke 146 comprises a cylindrical body covering the inner yoke 145, and is fixed to the flange 111 of the cylinder 110. A reciprocation path 148 which is a small space is formed between the outer yoke 146 and an outer peripheral surface of the inner yoke 145. A coil 147 is accommodated in the outer yoke 146 and is connected to a power supply (not shown).

The moving member 141 of the linear motor 140 comprises a permanent magnet 143 and a cylindrical holding member 144 which holds the permanent magnet 143. This cylindrical holding member 144 is accommodated in the reciprocation path 148 such that the cylindrical holding member 144 can reciprocate therein, and is connected to the flange 123 of the piston 120. The permanent magnet 143 is disposed at a position opposed to the coil 147, and a constant fine gap is formed therebetween. The inner yoke 145 and the outer yoke 146 are concentrically disposed so as to hold the fine gap over the entire region of a periphery thereof.

A head cover portion 153 includes a suction valve and a discharge valve for charging and discharging refrigerant to and from a compression chamber 151, and is fixed to an end surface of the flange 111 of the cylinder 110 through a valve plate 152. A suction valve (not shown) and a discharge valve (not shown) which can be brought into communication with the compression chamber 151 are mounted to the valve plate 152, and these valves are respectively connected to a suction-side space 156 and a discharge-side space 157 provided in the head cover portion 153.

Refrigerant is supplied into the hermetic vessel 100 from the suction pipe 154, and is introduced toward a suction side of the head cover portion 153. Compressed refrigerant is discharged out from a discharge pipe 155 connected to the hermetic vessel 100 from the side of the head cover portion 153.

The compressing mechanism portion and the linear motor 140 provided in the hermetic vessel 100 are classified into piston-side mechanism members and cylinder-side mechanism members. The piston-side mechanism members include the piston 120 and the moving member 141, and mechanism members such as a bolt for connecting the moving member 141 and the piston 120.

The cylinder-side mechanism members include the cylinder 110, the stator 142, the valve plate 152, the head cover portion 153 and a mechanism member 150 around the cylinder 110.

Leaf springs 160 and 161 which are first elastic members are disposed on the opposite ends of the hermetic vessel 100 and elastically support the cylinder-side mechanism member in the hermetic vessel 100.

A driving spring which is a second elastic member comprises a coil spring 130*a* and a coil spring 130*b*. The coil spring 130*a* and the coil spring 130*b* provide the piston 120 with a force in the axial direction. One end of the coil spring 130*a* is supported by the hermetic vessel 100, and the other end is supported by a bottom surface 122 of the cylindrical portion 121 of the piston 120. One end of the coil spring 130*b* is supported by the flange 111 of the cylinder 110, and the other end is supported by the bottom surface 122 of the cylindrical portion 121 of the piston 120. The piston 120 is sandwiched between the coil spring 130*a* and the coil spring 130*b* in this manner. At that time, the coil springs 130*a* and 130*b* are provided with constant initial deflection so that the springs swing in their compressed states at the time of operation.

As shown in FIG. 2, the leaf springs 160 and 161 which elastically support the cylinder-side mechanism member in the hermetic vessel 100 comprise a pair of substantially C-shaped leaf springs 160*a* and 160*b* as a combination. The coil spring 130*a* is disposed in a row utilizing a central space 170.

Next, the operation of the linear compressor having the above structure will be explained.

First, if the coil 147 of the outer yoke 146 is energized, magnetic force which is proportional to the current is generated between the coil 147 and the permanent magnet 143 of the moving member 141 in accordance with Fleming's left-hand rule. A driving force is applied to the moving member 141 for moving the moving member 141 in its axial direction by this thrust. Since the cylindrical holding member 144 of the moving member 141 is connected to the flange 123 of the piston 120, the piston 120 moves. Here, the coil 147 is energized with sine wave, thrust in the normal direction and thrust in the reverse direction are alternately generated in the linear motor. By the alternately generated thrust in the normal direction and thrust in the reverse direction, the piston 120 reciprocates.

The refrigerant is introduced into the hermetic vessel 100 from the suction pipe 154. The refrigerant introduced into the hermetic vessel 100 passes through the suction valve mounted to the valve plate 152 from the suction-side space 156 of the head cover portion 153, and enters the compression chamber 151. The refrigerant is compressed by the piston 120, and passes through the discharge-side space 157 of the head cover portion 153 from the discharge valve mounted to the valve plate 152, and is discharged out from the discharge pipe 155.

Vibration of the hermetic vessel 100 caused by reciprocating motion of the piston 120 at the time of operation becomes extremely small because amplitude of the piston-side mechanism members such as the piston 120 and the moving member 141, and amplitude of the cylinder-side mechanism members such as the cylinder 110 and the stator 142 becomes opposite in phase. In this embodiment, mass of the piston-side mechanism member such as the piston 120 and the moving member 141 is defined as Mp, mass of the cylinder-side mechanism member such as the cylinder 110 and the stator 142 is defined as Mm, synthetic spring constant of supporting leaf springs 160 and 161 is defined as k1, spring constant of the coil spring 130*a* is defined as k2, and a relation of substantially Mp×k1=Mm×k2 is established. With this structure, vibration displacement of the hermetic vessel 100 becomes substantially 0, and a linear compressor having almost no vibration can be obtained. This is shown in FIG. 3, and can be explained by spring/mass model. In FIG. 3, k1 represents synthetic spring constant of the supporting leaf springs 160 and 161, k2 represents the coil spring 130*a*, k3 represents the coil spring 130*b*, kg represents gas spring constant generated in the compression chamber 151, ks represents spring constant of the supporting spring of the compressor body, Mp represents mass of the piston-side mechanism member such as the piston 120 and the moving member 141, Mm represents mass of the cylinder-side mechanism member such as the cylinder 110 and the stator 142, and Ms represents mass of the hermetic vessel 100. This equation of this model can be expressed by an equation 1 based on the following conditions: amplitude displacement of the piston 120 is defined as Xp, amplitude displacement of the cylinder-side mechanism member such as the cylinder 110 and the stator 142 is defined as X, amplitude displacement of the hermetic vessel 100 is defined as Xs, thrust of the linear motor 140 acting on the piston 120 is defined as F and angular frequency of the piston 120 is defined as ω. Attenuation is omitted.

$$\left(-\omega^2\begin{bmatrix} Mm & 0 & 0 \\ 0 & Mp & 0 \\ 0 & 0 & Ms \end{bmatrix} + \begin{bmatrix} k1+k2+kg & -k3-kg & -k1 \\ -k3-kg & k2+k3+kg & -k2 \\ -k1 & -k2 & k1+k2+ks \end{bmatrix}\right)\begin{Bmatrix} X \\ Xp \\ Xs \end{Bmatrix} = \begin{Bmatrix} F \\ -F \\ 0 \end{Bmatrix}$$

If forcible displacement S is given to the piston 120, the amplitude displacement Xp of the piston 120 becomes Xp=X+S, and the above equation can be simplified as shown in the following equation. The amplitude displacement Xs of the hermetic vessel 100 can be obtained by solving the following equation.

$$\left(-\omega^2\begin{bmatrix} Mm+Mp & O \\ O & Ms \end{bmatrix} + \begin{bmatrix} k1+k2 & -k1-k2 \\ -k1-k2 & k1+k2+ks \end{bmatrix}\right)\begin{Bmatrix} X \\ Xs \end{Bmatrix} =$$

-continued $$\begin{Bmatrix} \omega^2 \cdot Mp \cdot S - k2 \cdot S \\ k2 \cdot S \end{Bmatrix}$$

When the relation of Mp×k1=Mm×k2 is established, it is found that the amplitude displacement Xs of the hermetic vessel 100 becomes 0 irrespective of the driving frequency.

As explained above, according to the present embodiment, a force in reciprocating axial direction is given to the piston 120 by the driving coil spring 130*a* whose one end is supported by the hermetic vessel 100, and the cylinder-side mechanism member is elastically supported in the hermetic vessel 100 by the leaf springs 160 and 161 so that vibrating directions of the cylinder-side mechanism member and the driving coil spring become the same. Therefore, amplitude of the piston-side mechanism member and amplitude of the cylinder-side mechanism member becomes opposite in phase, and amplitude of the hermetic vessel 100 becomes small. Further, since the relation of Mp×k1=Mm×k2 is established, the amplitude displacement Xs of the hermetic vessel 100 becomes substantially 0, and a linear compressor having almost no vibration can be obtained. The elastic members of the cylinder-side mechanism member which are elastically supported in the hermetic vessel 100 comprises the combination of the pair of substantially C-shaped leaf springs 160*a* and 160*b*, and the coil spring is disposed in a row in the central space 170 as the elastic member 2, thus, the compressor can be reduced in size in its longitudinal direction. Further, the cylinder-side mechanism member such as the cylinder 110 and the stator 142 having great mass is elastically supported by the leaf springs which are strong against lateral load as compared with the coil spring. Therefore, high reliability can be obtained even if disturbance force is applied to the compressor.

Next, another embodiment of the present invention will be explained based on FIG. 4.

Figure 4:
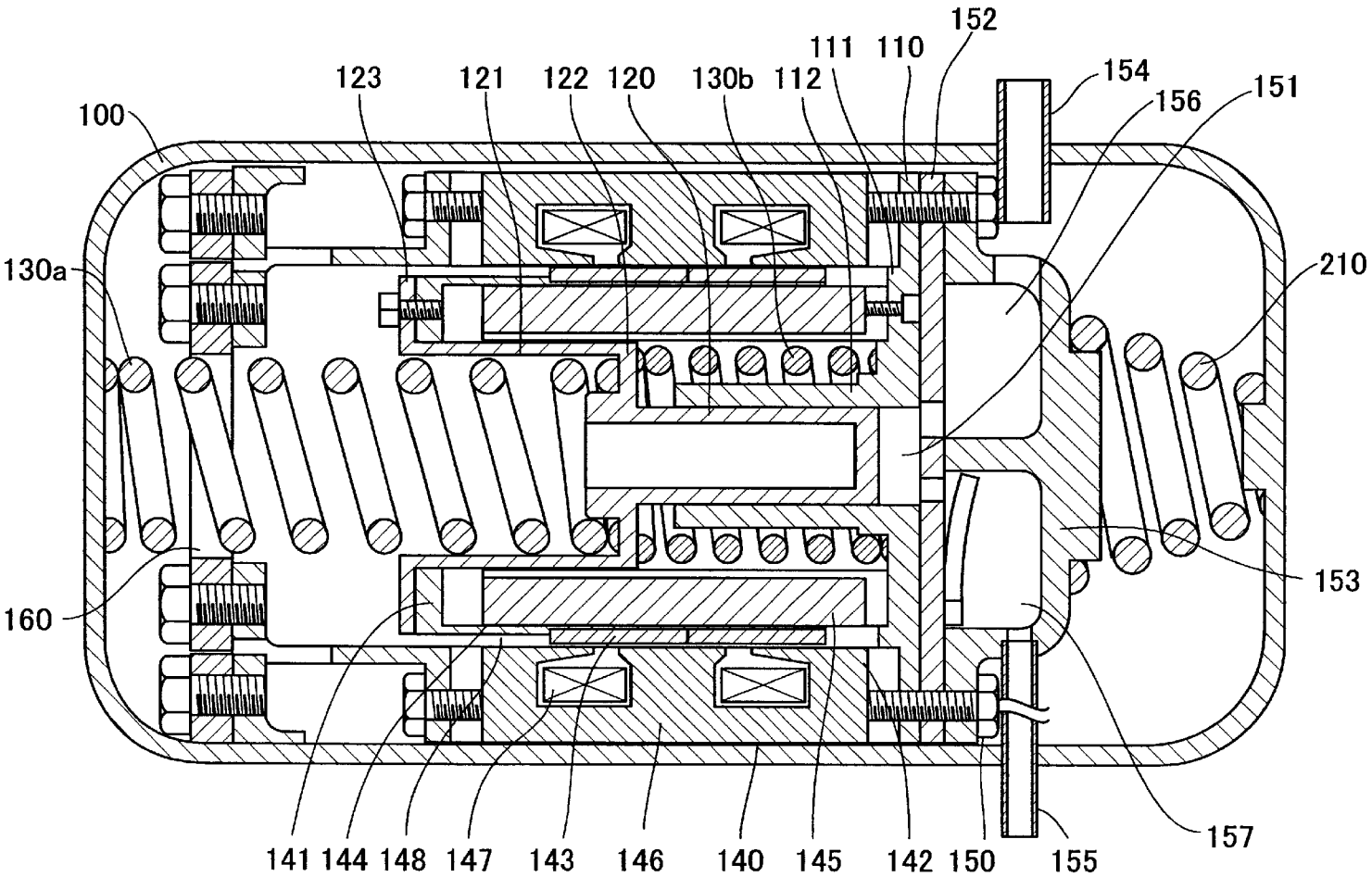
FIG. 4 is a side sectional view showing an entire structure of a linear compressor according to another embodiment of the invention.

FIG. 4 is a side sectional view showing an entire structure of a linear compressor according to the other embodiment of the invention. The same members as those explained in the previous embodiment are designated with the same numbers and explanation thereof is omitted.

Figure 5:
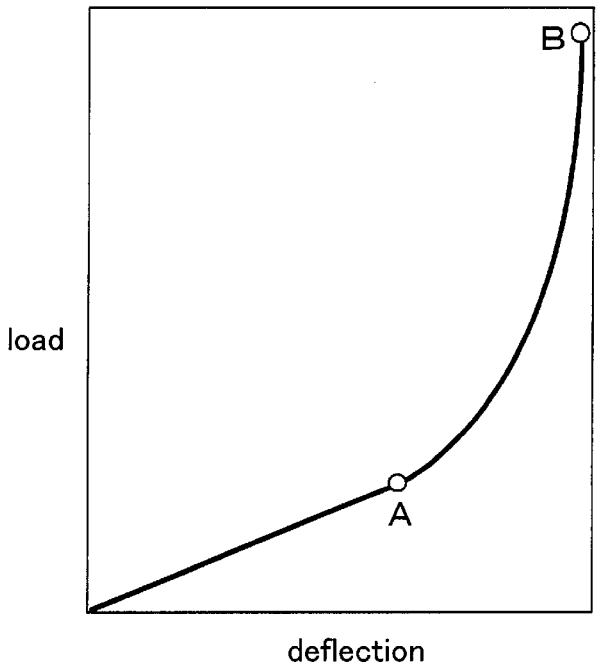
FIG. 5 is a diagram showing load characteristics of a conical coil spring according to one embodiment of the invention.

The conical coil spring 210 is used in the hermetic vessel 100 for a portion of the elastic member which elastically supports the cylinder-side mechanism member. As shown in FIG. 5, load characteristic of the conical coil spring is linear up to a certain displacement and is non-linear thereafter in which spring stiffness becomes high abruptly. With this characteristic, even if extremely great disturbance force which coincides with resonance frequency of the mechanism member in the hermetic vessel 100 is applied, if the conical coil spring 210 reaches a certain displacement, the resonance frequency of the mechanism member is deviated toward a higher value. Therefore, resonance disruption of the mechanism member is avoided. Further, since the non-linear spring comprises a coil spring which is easily produced, the spring can be produced with relatively low cost.

Figure 6:
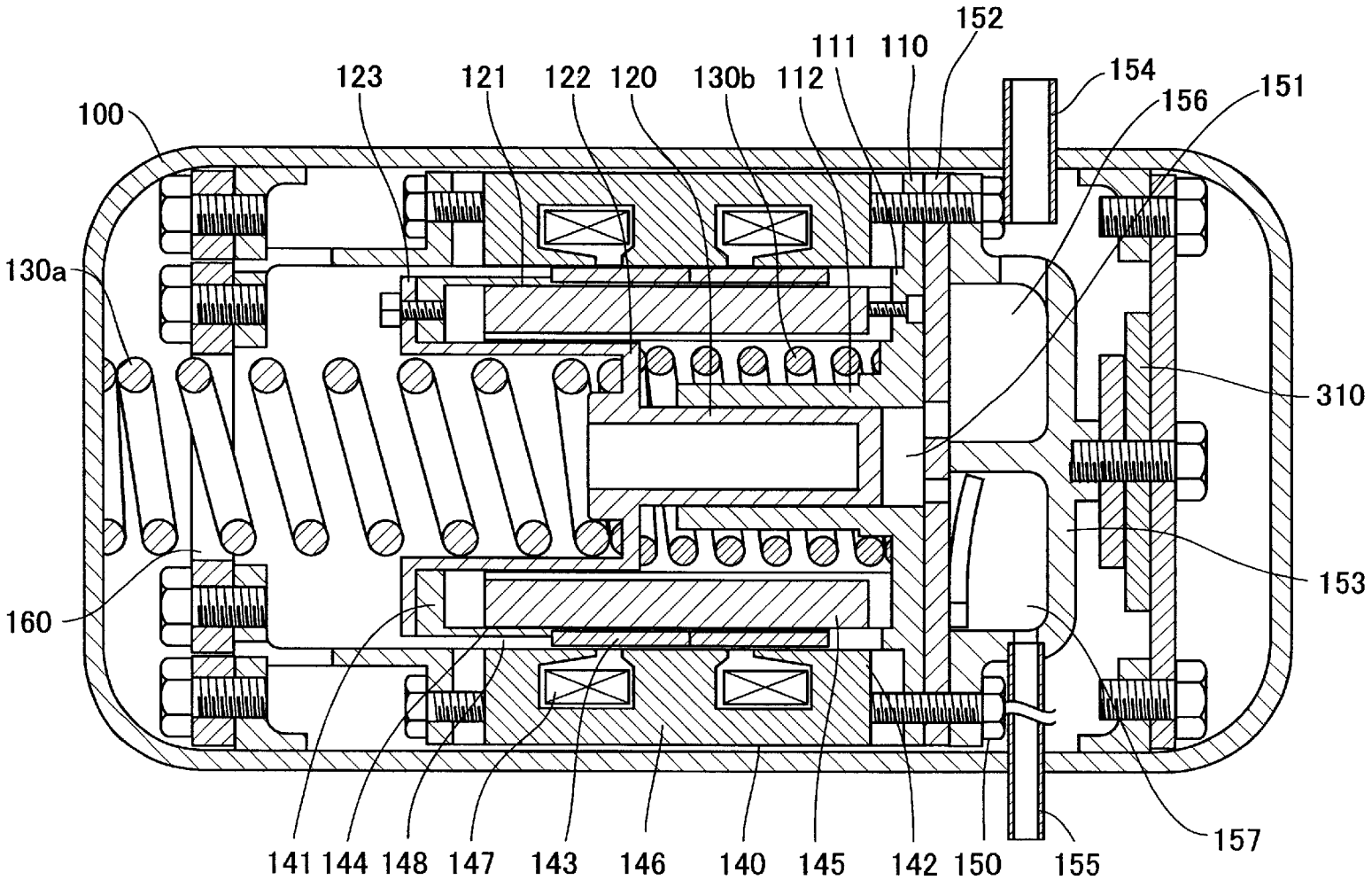
FIG. 6 is a sectional view showing an entire structure of a linear compressor according to another embodiment of the invention.

FIG. 6 is a sectional view showing an entire structure of a linear compressor according to another embodiment of the invention.

A non-linear laminated leaf spring 310 is used in the hermetic vessel 100 for a portion of the elastic member which elastically supports the cylinder-side mechanism member. The non-linear laminated leaf spring 310 also has the same non-linear characteristic as that of the load characteristic of the above conical coil spring 210 and thus, high reliability can be obtained even if the disturbance force is applied. Since the non-linear spring comprises the laminated leaf spring which is compact in its axial direction, the compressor can be reduced in size in its longitudinal direction.

Further, the linear compressor has smaller load in a direction perpendicular to an axis of its piston and has small sliding surface pressure. Therefore, if the linear compressor of the present invention is applied to $CO_2$ refrigerant in which it is difficult to lubricate with high pressure difference refrigerant, efficiency is extremely excellent as compared with another compressor and high reliability can be obtained.

According to the present invention, the cylinder-side mechanism member is elastically supported in the hermetic vessel by the first elastic member, and a reciprocating force in the axial direction is given to the piston-side mechanism member by a second elastic member whose one end is supported by the hermetic vessel. With this structure, since the amplitude of the piston-side mechanism member and the amplitude of the cylinder-side mechanism member are different in phase, vibration of the hermetic vessel becomes small.

Further, according to the invention, the first elastic member and the second elastic member respectively comprise spring members, and the first elastic member and the second elastic member are disposed such that their vibrating directions are the same. With this structure, amplitude of the piston and the moving member and amplitude of the cylinder other than the moving member and the mechanism member fixed to the cylinder becomes opposite in phase, and vibration transmitted to the hermetic vessel is canceled out. Therefore, a linear compressor having smaller vibration as compared with the first aspect can be obtained.

Further, according to the invention, a relation of substantially Mp×k1=Mm×k2 is established, in which mass of the piston-side mechanism member is defined as Mp, mass of the cylinder-side mechanism member is defined as Mm, spring constant of the first elastic member is defined as k1, and spring constant of the second elastic member is defined as k2. With this structure, the vibration displacement of the hermetic vessel becomes substantially 0, and a linear compressor having almost no vibration can be obtained.

Further, according to the invention, the first elastic member comprises a plurality of plate-like leaf springs, and high reliability can be obtained even if disturbance force is applied to the compressor.

Further, according to the invention, the first elastic member comprises a combination of a pair of substantially C-shaped leaf springs, the second elastic member is a coil spring, and the second elastic member is disposed in a central space of the first elastic member. With this structure, the compressor can be reduced in size in its longitudinal direction.

Further, according to the invention, the first elastic member is a non-linear spring having a linear spring stiffness up to a certain displacement and the spring stiffness is abruptly increased thereafter. With this structure, even if extremely great disturbance force which coincides with resonance frequency of the mechanism member in the hermetic vessel is applied, if the elastic member 1 reaches a certain displacement, the resonance frequency of the mechanism member is deviated toward a higher value. Therefore, resonance disruption of the mechanism member is avoided.

Further, according to the invention, the first elastic member is a coil spring. The spring can be produced with relatively low cost.

Further, according to the invention, the non-linear spring is a laminated leaf spring which is compact in its axial direction and thus, the compressor can be reduced in size in its longitudinal direction.

Further, according to the invention, the first elastic member is a laminated leaf spring. With $CO_2$ refrigerant in which it is difficult to lubricate with high different pressure refrigerant, efficiency is extremely excellent as compared with another compressor and high reliability can be obtained due to a feature of the linear compressor that a sliding surface pressure is small.

What is claimed is:

1. A linear compressor comprising a hermetic vessel having a compressing mechanism portion and a linear motor therein, wherein said compressing mechanism portion comprises a cylinder and a piston which reciprocates in the cylinder, said linear motor comprises a moving member which provides said piston with reciprocating driving force and a stator which is fixed to said cylinder and which forms a reciprocation path for said moving member, said compressing mechanism portion and said linear motor are classified into a piston-side mechanism member and a cylinder-side mechanism member, said piston-side mechanism member includes said piston and said moving member which is movable together with said piston, said cylinder-side mechanism member includes said cylinder and said stator being connected to said cylinder, said cylinder-side mechanism member is elastically supported at opposite ends in said hermetic vessel by a first elastic means and a reciprocating force in the axial direction is given to said piston-side mechanism member by a second elastic means whose one end is supported by said hermetic vessel.

2. A linear compressor according to claim 1, wherein said first elastic means and said second elastic means respectively comprise spring members, and said first elastic means and said second elastic means are disposed such that their vibrating directions are axially parallel.

3. A linear compressor according to claim 2, wherein a relation of substantially $Mp \times k1 = Mm \times k2$ is established, in which a mass of said piston-side mechanism member is defined as Mp, a mass of said cylinder-side mechanism member is defined as Mm, a spring constant of said first elastic means is defined as k1, and a spring constant of said second elastic means is defined as k2.

4. A linear compressor according to claim 2, wherein said first elastic means comprises a plurality of plate-like leaf springs.

5. A linear compressor according to claim 4, wherein said first elastic means comprises a combination of a pair of substantial C-shaped leaf springs, said second elastic means is a coil spring, and said second elastic means is disposed in a central space of said C-shaped leaf springs.

6. A linear compressor according to claim 2, wherein said first elastic means includes a non-linear spring having a linear spring stiffness up to a certain displacement and a spring stiffness which is abruptly increased thereafter.

7. A linear compressor according to claim 6, wherein said first elastic means includes a coil spring.

8. A linear compressor according to claim 6, wherein said first elastic means includes a laminated leaf spring.

9. A linear compressor according to any one of claims 1 to 8, wherein said linear compressor is operated using refrigerant comprising carbon dioxide.

* * * * *